US007191680B2

(12) United States Patent
Rixon et al.

(10) Patent No.: US 7,191,680 B2
(45) **Date of Patent: *Mar. 20, 2007**

(54) STEPPING MOTOR DIRECT DRIVE ADJUSTABLE PEDAL ASSEMBLY

(75) Inventors: Christopher Rixon, Tecumseh (CA); Jiyuan Ouyang, Windsor (CA)

(73) Assignee: Drivesol Worldwide, Inc., Troy, MI (US)

( * ) Notice: Subject to any disclaimer, the term of this patent is extended or adjusted under 35 U.S.C. 154(b) by 559 days.

This patent is subject to a terminal disclaimer.

(21) Appl. No.: 10/225,256

(22) Filed: Nov. 21, 2002

(65) Prior Publication Data

US 2003/0121355 A1 Jul. 3, 2003

Related U.S. Application Data

(63) Continuation-in-part of application No. 10/040,096, filed on Jan. 1, 2002, now abandoned.

(51) Int. Cl.
*G05G 1/14* (2006.01)

(52) U.S. Cl. ..... 74/512; 74/560

(58) Field of Classification Search ..... 74/512, 74/514, 560

See application file for complete search history.

(56) References Cited

U.S. PATENT DOCUMENTS

| | | | | |
|---|---|---|---|---|
| 3,586,953 A | | 6/1971 | Markkanen et al. | 318/685 |
| 3,643,524 A | | 2/1972 | Herring | 74/512 |
| 4,875,385 A | | 10/1989 | Sitrin | 74/512 |
| 4,989,474 A | | 2/1991 | Cicotte et al. | 74/512 |
| 5,161,476 A | | 11/1992 | Suzuki | 112/306 |
| 5,491,787 A | * | 2/1996 | Hashemi | 714/11 |
| 5,561,600 A | * | 10/1996 | McCombie | 701/111 |
| 5,625,269 A | * | 4/1997 | Ikeda | 318/696 |
| 5,632,183 A | | 5/1997 | Rixon et al. | 74/512 |
| 5,697,260 A | | 12/1997 | Rixon et al. | 74/514 |
| 5,722,302 A | | 3/1998 | Rixon et al. | 74/512 |
| 5,927,154 A | | 7/1999 | Elton et al. | 74/512 |
| 5,964,125 A | | 10/1999 | Rixon et al. | 74/514 |

(Continued)

FOREIGN PATENT DOCUMENTS

| | | | |
|---|---|---|---|
| JP | 60241797 A | * | 11/1985 |
| JP | 61094588 A | * | 5/1986 |

*Primary Examiner*—Chong H. Kim
(74) *Attorney, Agent, or Firm*—Howard & Howard Attorneys, P.C.

(57) ABSTRACT

A pair of first (14) and second (34) pedal levers is pivotally supported for rotation by a support (12). A pair of adjustment mechanisms (21, 41) interconnect the support (12) and the respective pedal levers (14, 34) and include rods (28, 48) for adjusting the operational position of the pedal levers (14, 34) along the rods (28, 48) between a plurality of adjusted positions. A stepper motor (52) and screw (32) unit is attached to the inner end of each rod (28, 48) for moving the respective pedal levers (14, 34) along the respective rods (28, 48). The assembly (10) is characterized by a controller (56) sending pulses of energy to each of the motors (52), measuring the time to reach a predetermined resistance condition of each motor during each pulse, and terminating energy to both motors (52) in response to the time being below a predetermined time period in any pulse to either motor, thereby to synchronize the movement of both pedal levers together.

6 Claims, 8 Drawing Sheets

U.S. PATENT DOCUMENTS 6,000,869 A * 12/1999 Lee ..... 400/279
6,151,984 A 11/2000 Johansson et al. ..... 74/512
6,205,883 B1 3/2001 Bortolon ..... 74/512
6,352,007 B1 3/2002 Zhang et al. ..... 74/512
6,431,304 B1 * 8/2002 Smythe ..... 180/334
6,450,061 B1 9/2002 Chapman et al. ..... 74/512
6,510,761 B2 1/2003 Zhang et al. ..... 74/512
6,698,309 B2 * 3/2004 Rixon et al. ..... 74/512
2002/0078782 A1 6/2002 Flynn ..... 74/512
2002/0078785 A1 6/2002 Zhang et al. ..... 74/512
2002/0096011 A1 7/2002 Chapman et al. ..... 74/512
2002/0194948 A1 12/2002 Sundaresan et al. ..... 74/560
2003/0005790 A1 1/2003 Liimatta et al. ..... 74/512

* cited by examiner

STEPPING MOTOR DIRECT DRIVE ADJUSTABLE PEDAL ASSEMBLY

RELATED APPLICATION

This application is a continuation-in-part of application Ser. No. 10/040,096 filed Jan. 1, 2002 now abandoned.

BACKGROUND OF THE INVENTION

1. Field of the Invention

The subject invention relates to an adjustable pedal assembly used in an automotive vehicle to vary the operating position of one or more of the foot pedals to mechanically or electrically control various vehicle systems, such as the clutch, brake and throttle systems.

2. Description of the Prior Art

Typically, adjustable pedal assemblies have used direct current electrical motors to rotate a drive cable that, in turn, rotates a worm gear to adjust the position of the pedal. Examples of such assemblies are shown in U.S. Pat. Nos.; 5,632,183; 5,697,260; 5,722,302 and 5,964,125 to Rixon et al, U.S. Pat. No. 3,643,524 to Herring, U.S. Pat. No. 4,875,385 to Sitrin, U.S. Pat. No. 4,989,474 to Cicotte et al and U.S. Pat. No. 5,927,154 to Elton et al. Other assemblies eliminate the cable and connect the worm gear more directly to pedal lever, as illustrated in U.S. Pat. No. 6,205,883 to Bortolon and U.S. Pat. No. 6,151,984 to Johansson et al. In order to stay within cost limitations, these assemblies require a relatively large number of parts, are noisy and imprecise in output. They also present difficult packaging parameters.

Strict standards have been developed in regard to the position of the brake pedal relative to the position of the accelerator pedal, i.e., the synchronization of movement of the brake and accelerator pedals. Some assemblies address this requirement by using one motor to drive the adjustment of both pedals, as shown in the aforementioned U.S. Pat. No. 5,722,302.

SUMMARY OF THE INVENTION AND ADVANTAGES

The subject invention provides an adjustable pedal assembly comprising a support for mounting the assembly to a vehicle structure and pivotally supporting first and second pedal levers for rotation about respective operational axes. A first electrically operated stepper motor includes a first set of windings for sequentially moving in increments of movement and interconnecting the support and the first pedal lever for adjusting the operational position of the first pedal lever relative to the support between a plurality of adjusted positions and a second electrically operated stepper motor including a second set of windings for sequentially moving in increments of movement and interconnecting the support and the second pedal lever for adjusting the operational position of the second pedal lever relative to the support between a plurality of adjusted positions. A controller sends pulses of electrical energy sequentially to the respective windings to incrementally rotate the first and second motors. The assembly is characterized by including a timer for measuring the time to reach a predetermined running current of either of the windings during each pulse and for terminating energy to both set of the windings in response to the time being below a predetermined time period.

Accordingly, the subject invention provides controller used in a multiple pedal assembly whereby the adjustable movement of the respective pedal levers is synchronized by shutting down electrical energy to both pedal levers adjustment motors in the event one of the motors becomes stalled as evidences by a shorter than the predetermined time to reach the preset running current. Such a time period for measuring a running condition is measured in milliseconds thereby preventing the motors and pedal adjustment from coming out of synchronization.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
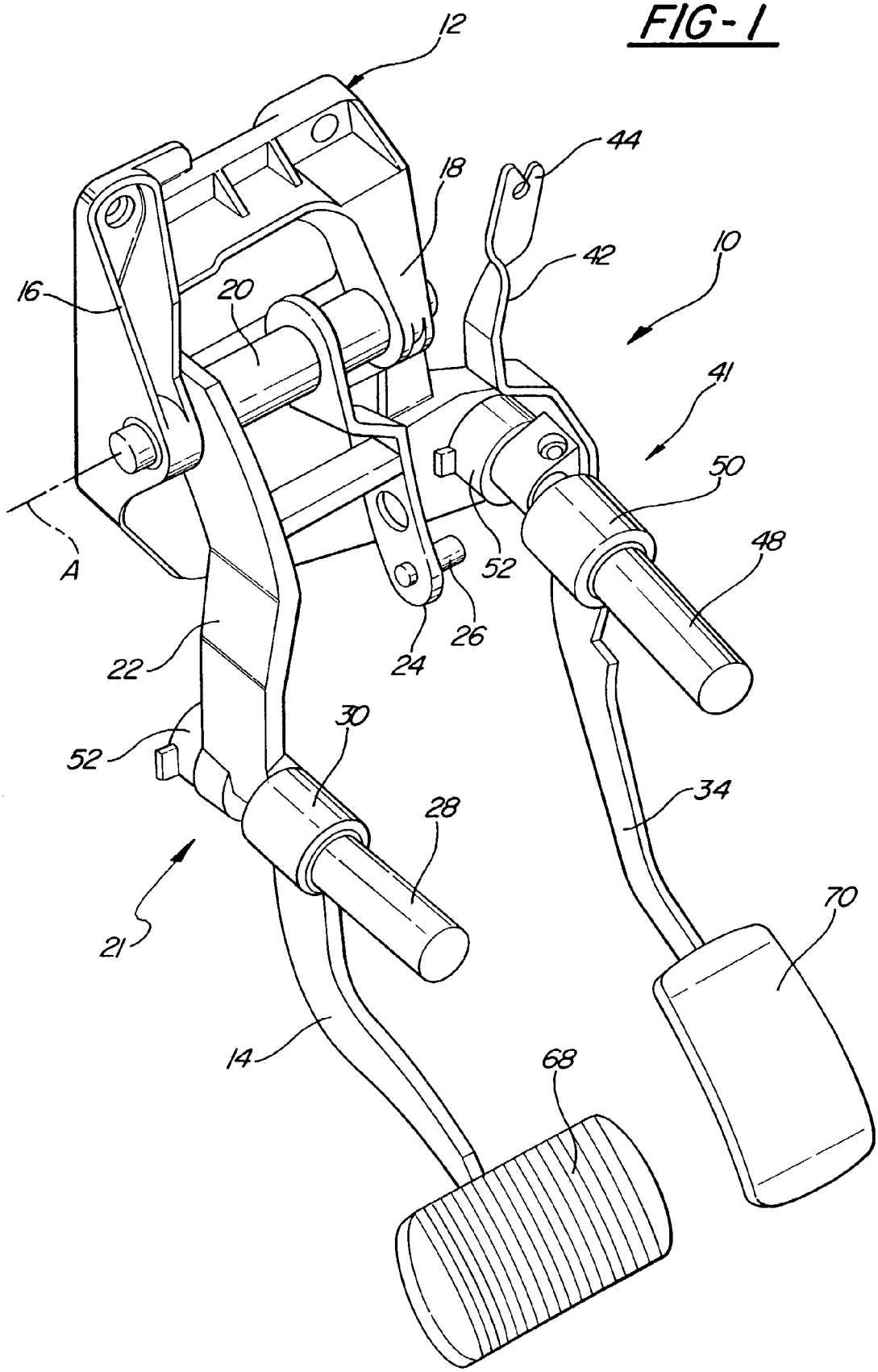
FIG. 1 is a perspective view from the left of a preferred embodiment.
Figure 2:
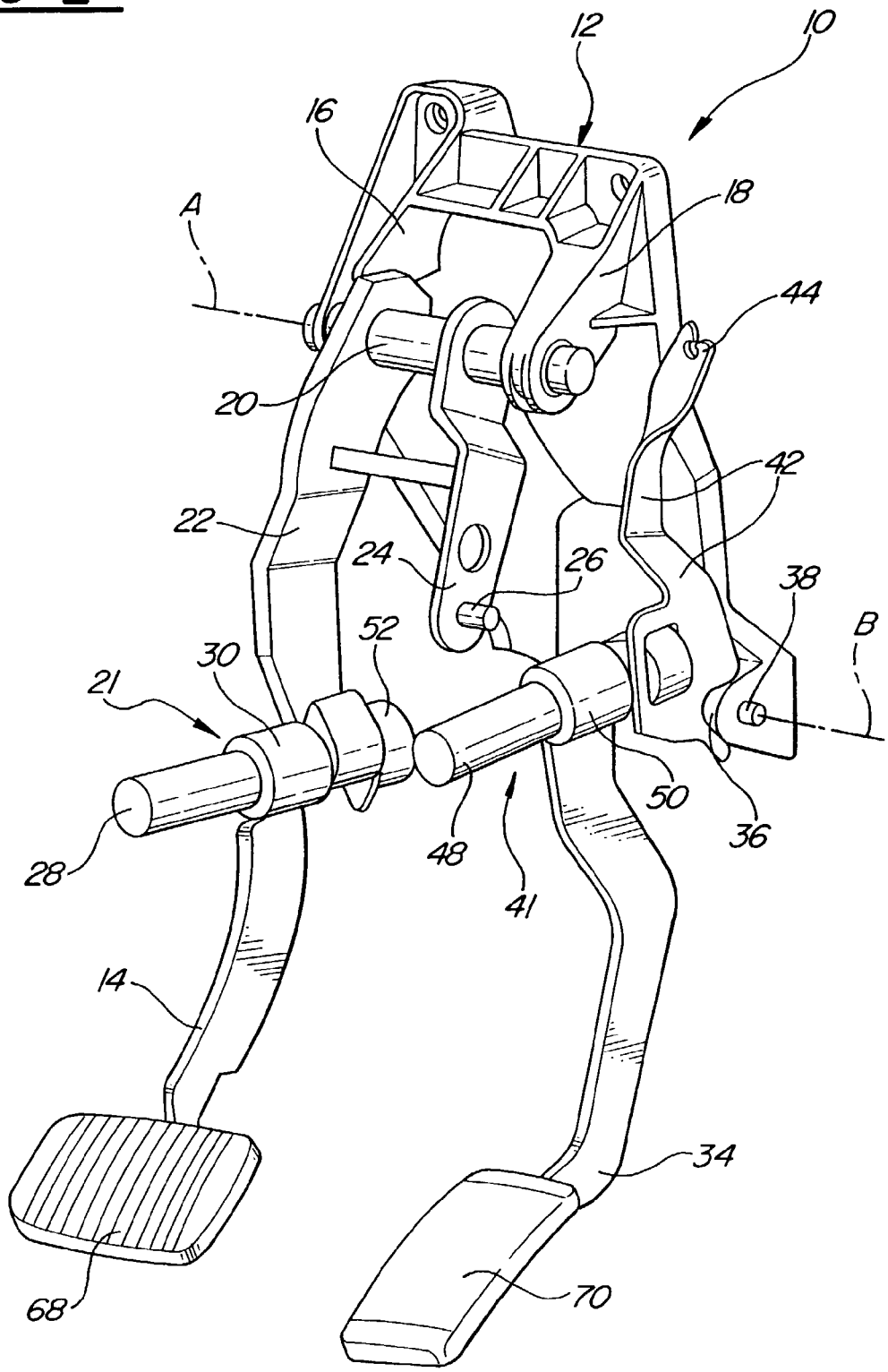
FIG. 2 is a perspective view from the right of the preferred embodiment.

Referring to the Figures, wherein like numerals indicate like or corresponding parts throughout the several views, an adjustable pedal assembly is generally shown at 10 in FIGS. 1 and 2. A support, generally indicated at 12, is included for mounting the assembly to a vehicle structure.

Figure 4:
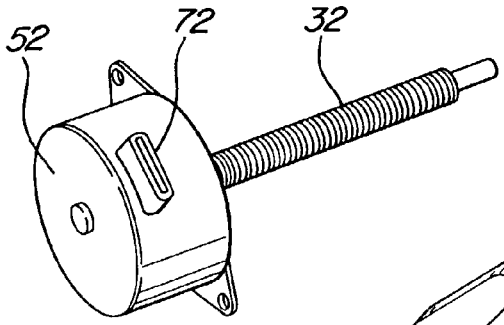
FIG. 4 is a perspective view of the motor and drive control.
Figure 5:
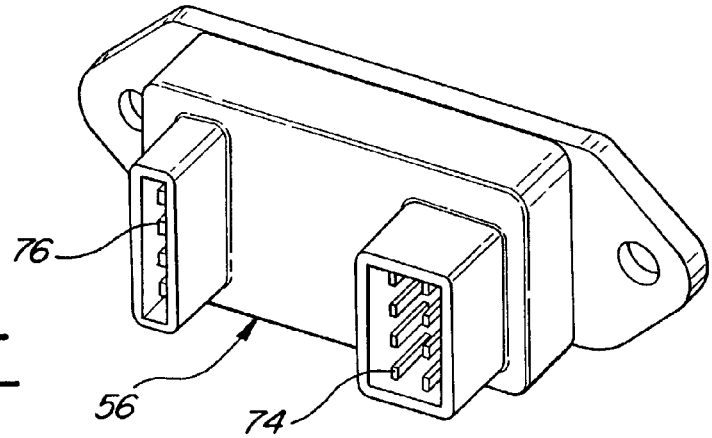
FIG. 5 is a perspective view of a controller of the subject assembly.
Figure 3:
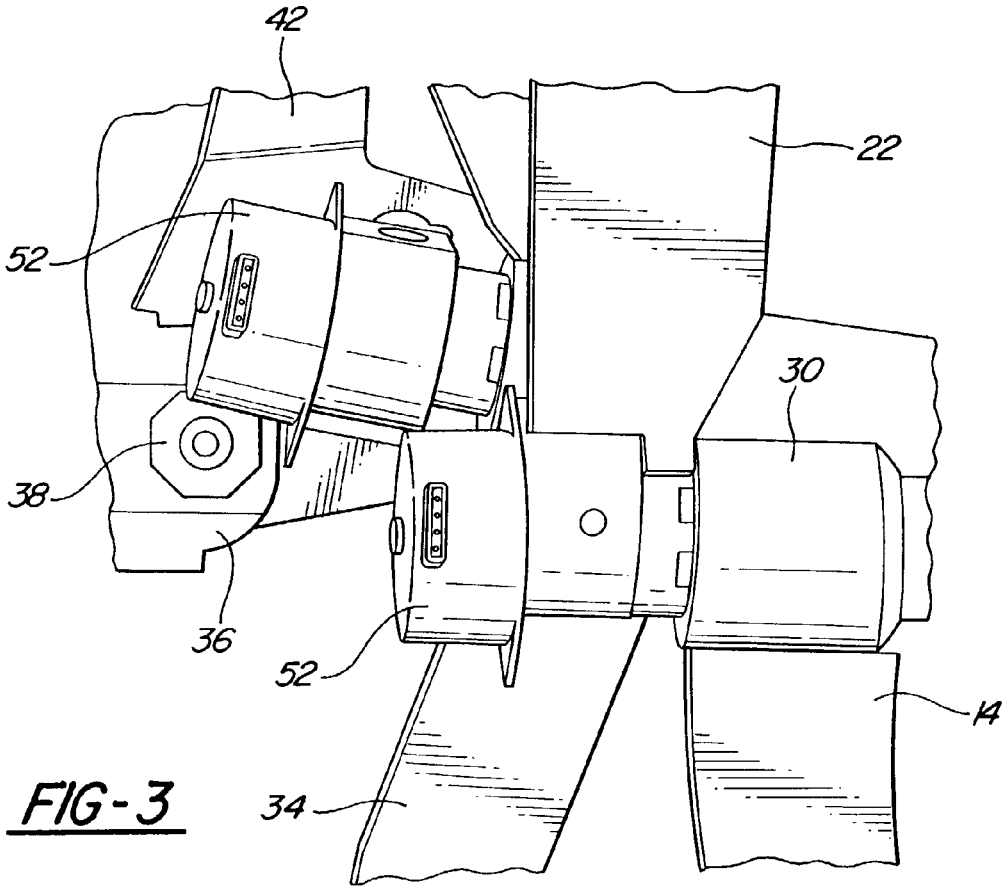
FIG. 3 is an enlarged side view showing the motors and pedal levers.

A first pedal lever 14 is pivotally supported for rotation about an operational axis A with respect to the support 12. The support 12 comprises a bracket having side flanges 16 and 18 that rotatably support a shaft 20. A first adjustment mechanism, generally indicated at 21, interconnects the support 12 and the pedal lever 14 for adjusting the operational position of the pedal lever 14 relative to the operational axis (A) between a plurality of adjusted positions. More specifically, the shaft 20 supports a first arm 22. A link 24 depends from the shaft 20 and supports an attachment 26 that connects to the vehicle system for operating a system thereof, e.g., a brake system. As is well known in the art, anyone of the shaft 20, arm 22 or link 24 could be connected to an electrical sensor for sending an electrical signal to a vehicle system instead of a mechanical output. The first adjustment mechanism also includes a guide, in the form of a rod 28, movably supported by the support 12, and the pedal lever 14 includes a collar 30 that is slidably supported by the rod 28. The rod 28 is hollow and a nut (not shown) is moved axially within the rod 28 by a screw 32, as shown in FIG. 4. Such an assembly is illustrated in the aforementioned U.S.

Pat. Nos. 5,722,302 and 5,964,125. However, as will be appreciated, the guide may take the form of a plate that slidably supports the pedal lever, the plate being either slidable or rotatable relative to the support.

The assembly 10 also includes a second pedal lever 34 pivotally supported for rotation about a second operational axis B with respect to the support 12. The bracket defining the support 12 includes an ear 36 that supports a pin 38. A second adjustment mechanism, generally shown at 41, interconnects the support 12 and the second pedal lever 34 for adjusting the operational position of the second pedal lever 34 relative to the second operational axis B between a plurality of adjusted positions. The second adjustment mechanism includes a second arm 42 pivotally supported by the pin 38. The upper end 44 of the second arm 42 is bifurcated to connect to a control cable, but as set forth above, the output may be electrical instead of mechanical. Again, the second adjustment mechanism 41 includes a guide, in the form of a rod 48, movably supported by the support 12, and the second pedal lever 34 includes a collar 50 that is slidably supported by the rod 48. The rod 48 is hollow and a nut (not shown) is moved axially within the rod 48 by a screw 32, as shown in FIG. 4. This screw 32 and nut arrangement can be like that shown in the aforementioned Rixon et al patents.

The assembly 10 is characterized by each of the mechanisms 21 and 41 including an electrically operated motor 52 for sequentially moving in increments of movement. Such a motor 52 indexes when energized in a programmed manner. The normal operation consists of discrete angular motions of uniform magnitude rather than continuous motion. A shown in FIG. 6, each motor 52 includes a plurality of windings 54. Each motor 52 has a housing surrounding the motor 52 and the screw 32 extends from the housing whereby the screw 32 and motor are a compact and universal unit. A motor housing is attached to the respective ends of the rods 28 and 48 with the screw 32 thereof extending into the associated rod 28 or 48 for moving the pedal levers 14 and 34 between the adjusted positions. It is important that the motor 52 be connected directly to the screw 32, i.e., that the screw 32 extends out of and is supported by the housing surrounding the motor 52. No loads from the operator to the pedal lever occur during the adjustment and the force required to move the collars 30 and 50 along the rods 28 and 48 is relatively low. However, the collars 30 and 50 cock or tilt relative to the axis of the rods 28 and 48 in response to a force on the pedal pads 68 or 70. This tilting or cocking locks the collar 30 and/or 50 to the associated rod 28 or 48 whereby the force is transferred to the support 12 and not to the motor/screw 52/32 unit.

Figure 6:
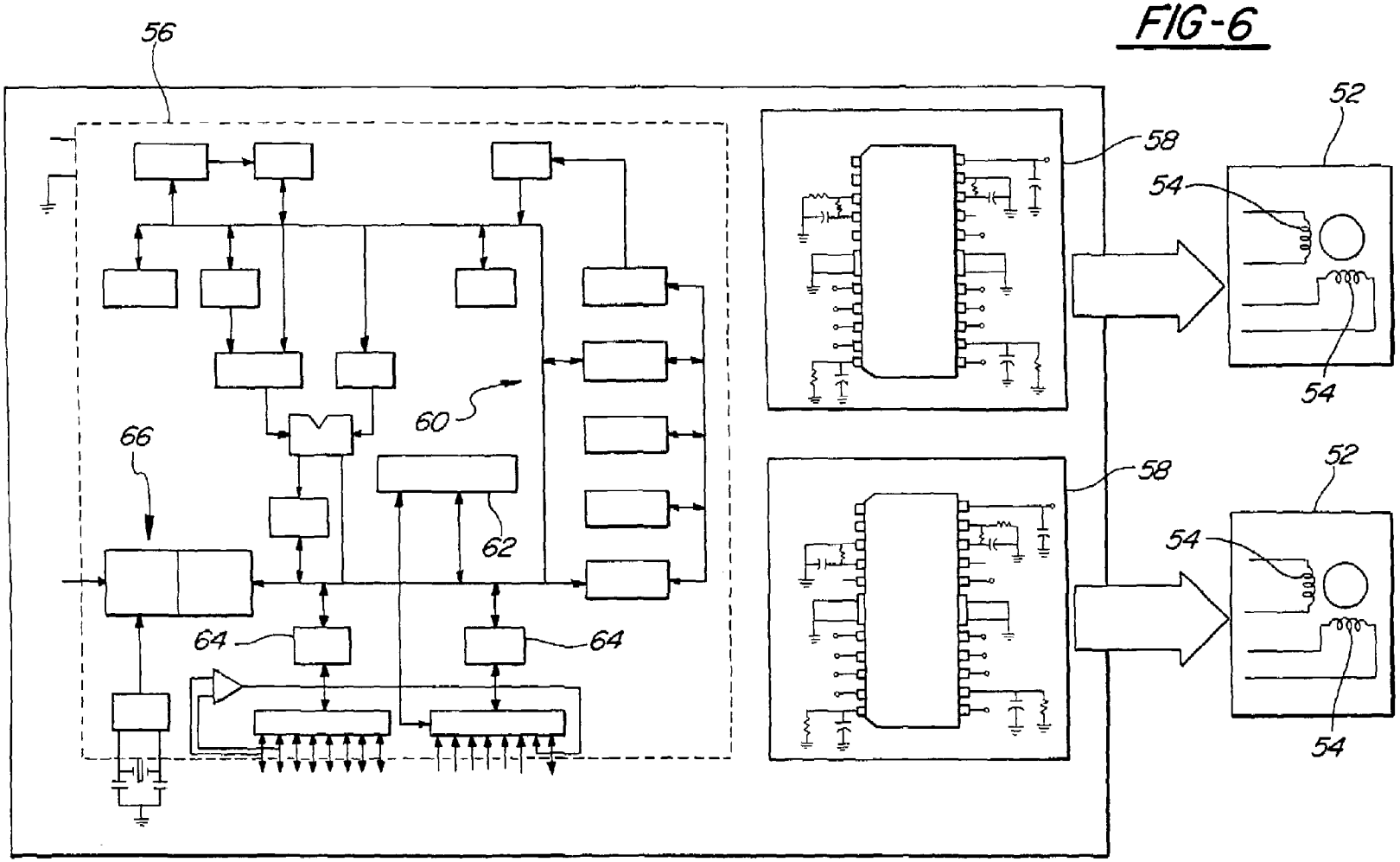
FIG. 6 is schematic view of the controller and motors.
Figure 7:
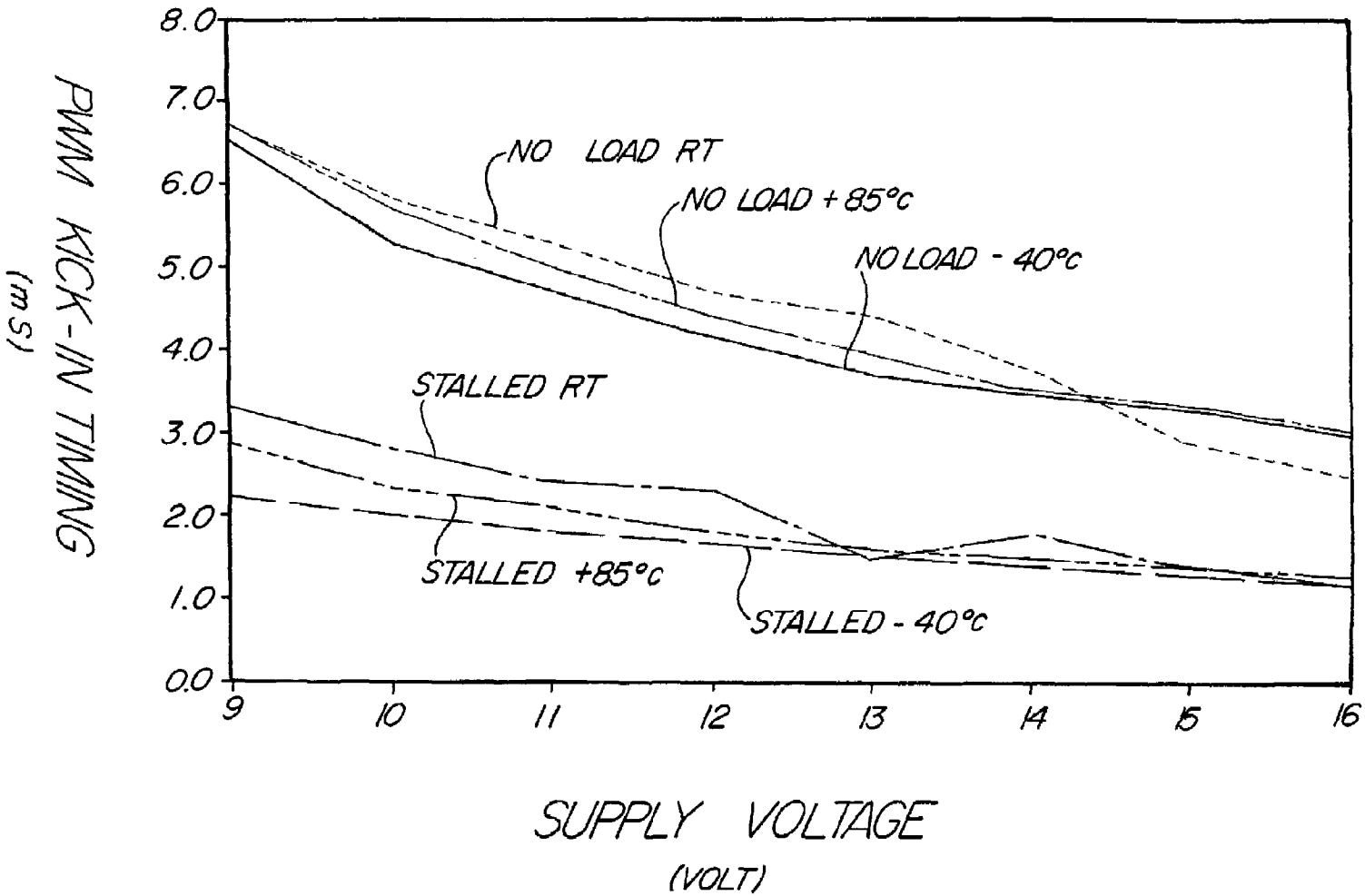
FIG. 7 is a graph showing the voltage timing.

As shown in FIG. 6, a controller 56 is included for sending pulses of electrical energy sequentially to the windings 54 to incrementally rotate the motor 52 through a predetermined angle in response to each pulse. Each motor 52 includes a drive circuit 58 interconnecting the controller 56 and the respective drives 58, which drives, in turn, energize the windings 54. The controller 56 includes a memory, generally shown at 60 in FIG. 6, for summing the pulses to keep track of the operational position of the pedal lever 14 in all adjusted positions. The controller 56 also includes a timer 62 for measuring the time to reach a predetermined pulse width modulation sufficient to rotate the motor 52. Attendant to this, the controller 56 includes latches each of which includes a voltage meter 64 for determining the voltage applied during the measured time to reach the predetermined pulse width modulation. The controller 56 includes a coordinator 66 for measuring the time to reach the predetermined pulse width modulation to alter the pulses of electrical energy to move the pedal lever 14 to the desired operational position in response to the time being outside a predetermined limit. In order to prevent the effects of the stall of a motor 52, thereby adversely affecting the desired or programmed position of the pedal lever, the controller 56 detects a stall and adjusts the pedal lever position or shuts down the system. When each winding 54 of a motor 52 is energized, the current sent to the motor 52 rises until a pulse width modulation (PWM) set point is reached. The time from energizing the winding to reaching the PWM set point is based on the voltage applied to the winding and any load on the system. As shown in FIG. 7, a stalled motor 52 differs from a properly operating motor 52 by the measured time from energization of the windings to reaching PWM set point, the measured time for a properly operating motor being approximately twice the measured time for a stalled motor. Accordingly, the controller 56 measures the time and voltage to detect a stall, and when one occurs, corrects to reposition the motor to the programmed position. In addition, the controller 56 includes a software program for adjusting the respective operational positions of the first 14 and second 34 pedal levers in a predetermined relationship to one another.

In order to accumulate the data depicted in FIG. 7, a series of tests are run on a stepper motor 52 wherein the controller 56 sends pulses of electrical energy sequentially to the windings 54 of the motor 52. Various different voltages (labeled OUT1A Voltage on the left of each of FIGS. 8–10 and on the x axis of FIG. 7) are applied. The current is represented by measuring the voltage across a resistor (labeled $R_s$ Voltage on the right of each Figure). Each Figure shows one full pulse and the beginning of a second pulse.

Figure 8:
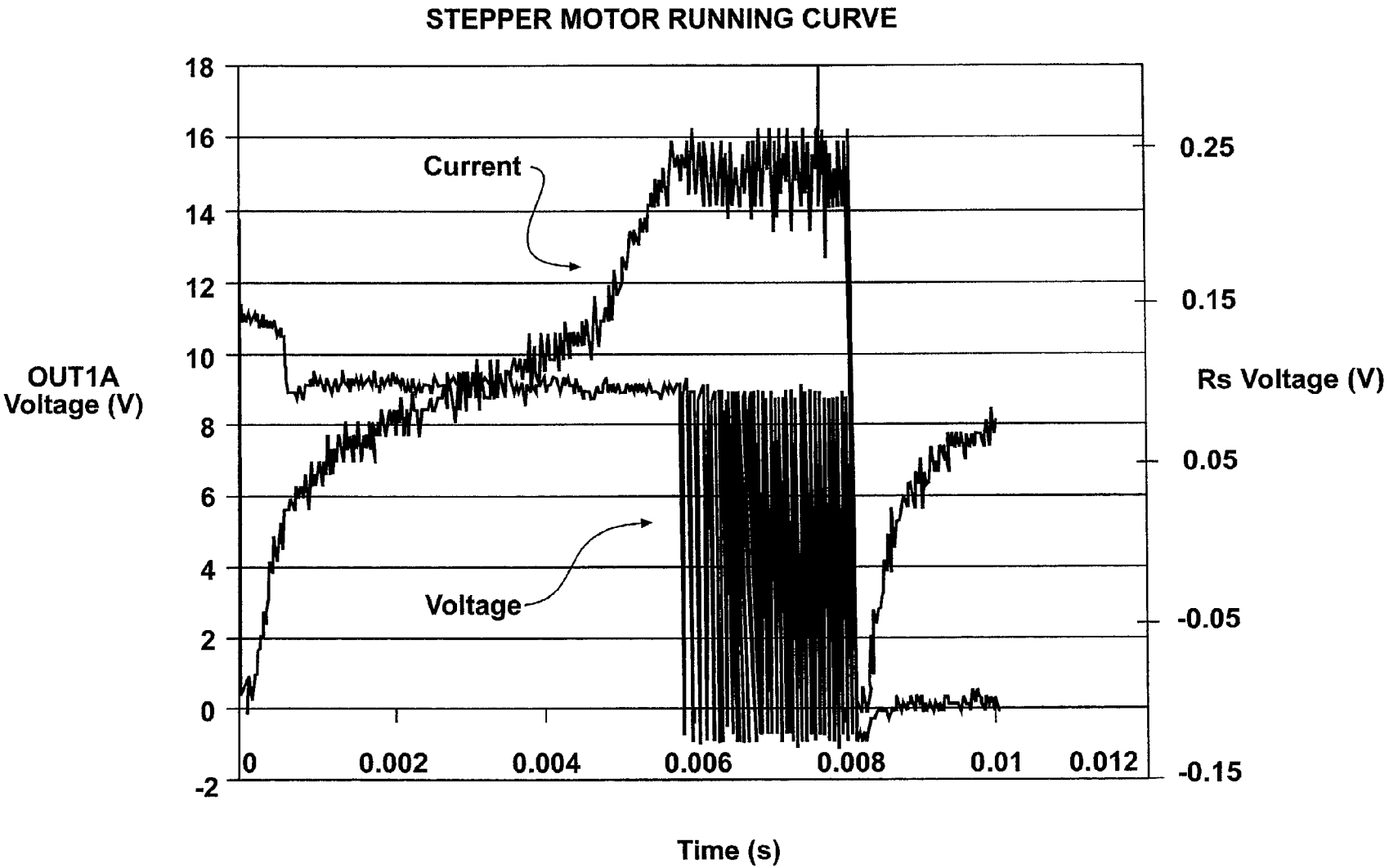
FIG. 8 is a plot of kick-in times versus current and voltages in each pulse of energy sent to a stepper motor for a no load condition of the motor.
Figure 9:
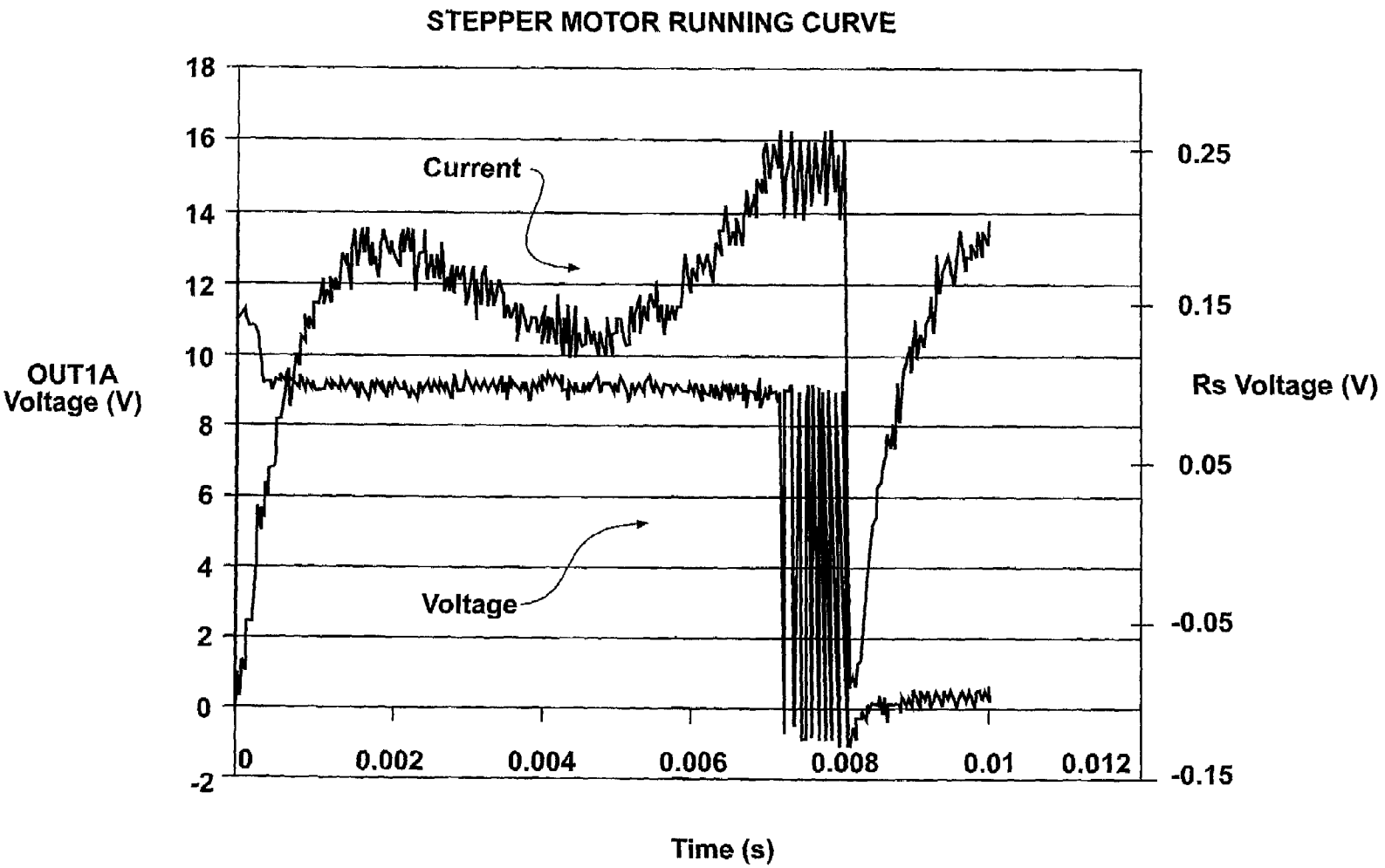
FIG. 9 is a plot like FIG. 8 but showing a motor loaded condition.
Figure 10:
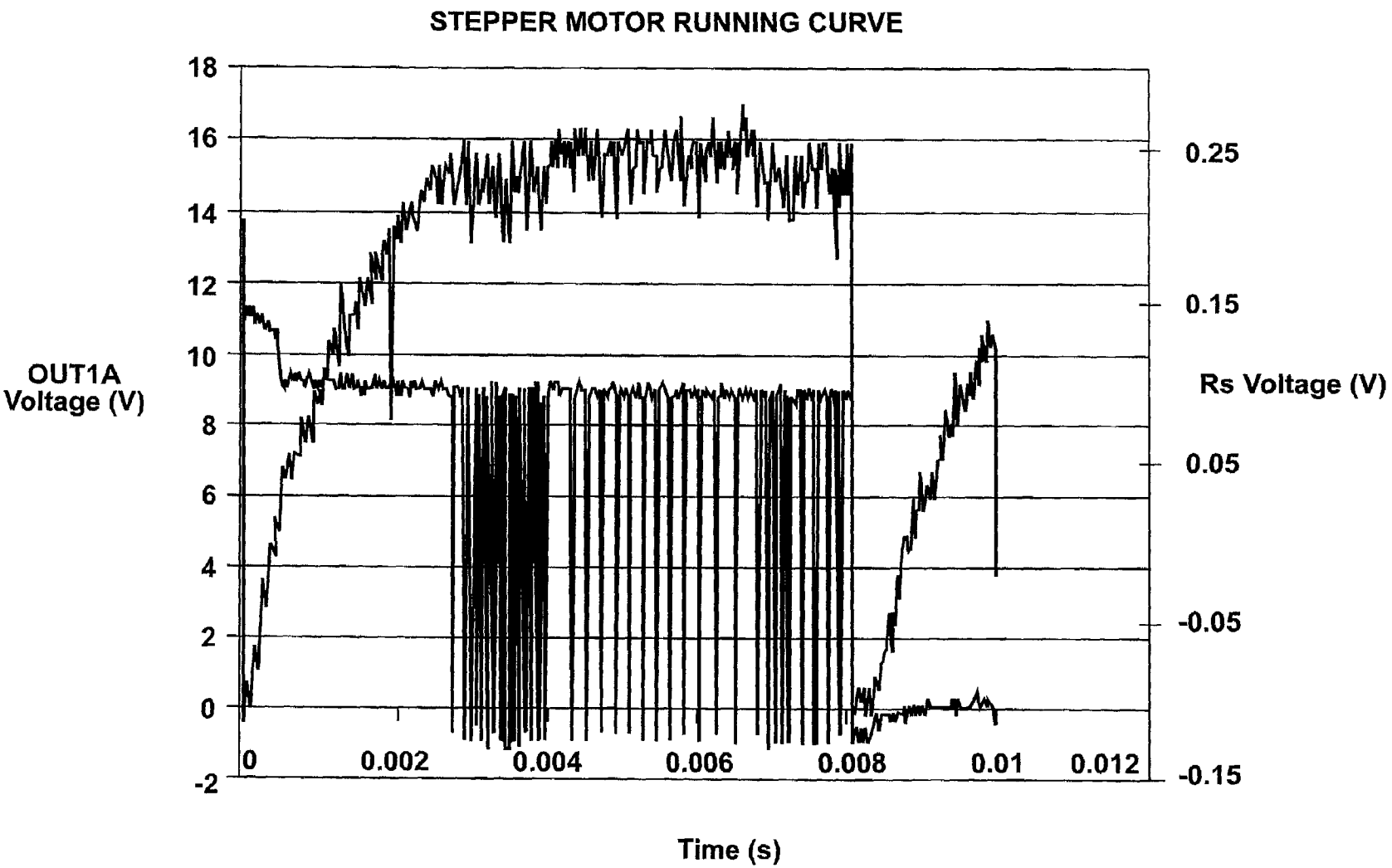
FIG. 10 is a plot like FIGS. 8 and 9 but showing a stalled condition where the time required in one pulse for the running current to reach a preset limit is much less than a normal running condition.

The controller 56 includes one or two pulse width modulators (PMW) for receiving each pulse of electrical energy for oscillating that energy at a very high frequency in each pulse to the windings of the stepper motors 52. The plot in FIG. 8 is a result of applying a voltage in each pulse and without a load on the motor 52. The bottom of FIGS. 8–10 presents a scale of time in milliseconds for the PMW to reach its operating modulation, i.e., kick-in timing, which is about 0.006 seconds (6 milliseconds) in FIG. 8. The kick-in time for a normal load on the motor 52 with the same voltage applied is illustrated in FIG. 9 and is about 0.008 seconds. However, the kick-in time for a stalled motor 52 increases at a much faster rate as illustrated in FIG. 10. In other words, the running current shoots up rapidly when the motor does not turn, which could occur in the over load situation or something jamming operation. As illustrated in FIG. 10, the kick-in time for the stalled motor 52 is about 0.003 seconds.

The kick-in times for each of the no-load and stalled results for various different voltages are plotted on the x axis in FIG. 7. The upper three curves in FIG. 7 represent the normal kick-in times under no load conditions for the various voltages with each curve being at different temperatures. The lower there curves in FIG. 7 represent the kick-in times when the motor is in a stalled condition for the same various voltages and at the same temperatures.

In order to keep the first and second motors 52 in synchronization to synchronize the adjustment of the operational positions of the first 14 and second 34 pedal levers, a curve is drawn between the two sets of curves in FIG. 7 to select a predetermined time period at which the energy to both motors 52 will be terminated. The time to reach a predetermined current, as illustrated in right scale of FIGS. 8–10, is measured by the timer 62 for each motor 52, and should that time period be below the predetermined selected time, i.e., the curve between the two sets in FIG. 7, the controller includes a switch to shut down the electrical energy pulses to the PMW to stop both motors 52. In order to restart, the system must be re-energized as by hitting the start button again. Accordingly, the timer 62 measures the time to reach a predetermined resistance condition of either of the motor windings 54 during each pulse and terminates the energy supply to the windings of both motors in response to that time being below a predetermined time period, thereby preventing the adjustment of the pedal positions from coming out of sychronization.

It is desirable that the pedal levers 14 and 34 be adjusted in unison to accommodate different operators. The controller 56 sending equal and simultaneous signals to the respective motors 52 may accomplish this. However, in some cases where the mounting of the two pedal levers 14 and 34 differ substantially (as is in the embodiment illustrated herein), the controller may send disproportionate signals to the two motors to maintain equal or equivalent movement of the pedal pads 68 and 70 on the lower or distal ends of the respective pedal levers 14 and 34. In any case, the measurement and timing of the resistance indicating a stall will shut down both motors to maintain the adjustment in proportional synchronization. Once the motors are shut down, the operator recognizes a stall or stoppage and relieves foot pressure from the pedal or pedals and re-starts the controller to send pulses to the motors. If the stall condition continues, the system is mechanically locked and maintenance is required, but without damage to the motors.

An electrical connector 72 for the winding 54 extends out of the motor housing. The controller 56 and motor drive 58 are disposed within a separate housing from which extends an electrical connector 74 to connect to an electrical cable which divides and connects to the two motor connectors 72. An additional electrical connector 76 connects to an electrical cable that leads to the vehicle system.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. An adjustable pedal assembly comprising;

a support (12) for mounting said assembly to a vehicle structure, a first pedal lever (14) pivotally supported for rotation about an operational axis (A) with respect to said support (12), a first electrically operated stepper motor (52) including a first set of windings (54) for sequentially moving in increments of movement and interconnection said support (12) and said first pedal lever (14) for adjusting the operational position of said pedal lever (14) relative to said support (12) between a plurality of adjusted positions, a second pedal lever (34) pivotally supported for rotation about a second operational axis (B) with respect to said support (12), a second electrically operated stepper motor (52) including a second set of windings (54) for sequentially moving in increments of movement and interconnecting said support (12) and said second pedal lever (34) relative to said support (12)(B) between a plurality of adjusted positions, and a controller (56) that sends pulses of electrical energy sequentially to said respective windings (54) to incrementally rotate said first (52) and second (53) motors, said assembly characterized by including a timer (62) that measures a the time to reach a predetermined resistance condition of either of said windings during each pulse and that terminates energy to both of said windings in response to said time being below a predetermined time period.

2. An assembly as set forth in claim 1 wherein said controller (56) includes a first pulse width modulator for receiving said pulses of energy for oscillating said energy in each pulse to said first winding of said first motor at a first predetermined frequency, and a second pulse width modulator for receiving said pulses for oscillating said energy in each pulse to said second winding of said second motor at a second predetermined frequency.

3. An assembly as set forth in claim 2 including a guide (28) movably supported (20) by said support (12) and said pedal lever (14) is slidably supported by said guide (28).

4. An assembly as set forth in claim 3 wherein said adjustment mechanism (21) includes a screw (32) for moving said pedal lever (14) between adjusted positions, a motor housing surrounding said motor (52), said screw (32) extending from said housing.

5. An adjustable pedal assembly comprising;

a support (12) for mounting said assembly to a vehicle structure, a first pedal lever (14) pivotally supported for rotation about an operational axis (A) with respect to said support (12), a first electrically operated motor (52) including a first winding (54) for sequentially moving in increments of movement and interconnecting said support (12) and said first pedal lever (14) for adjusting the operational position of said pedal lever (14) relative to said support (12) between a plurality of adjusted positions, a controller (56) that sends pulses of electrical energy sequentially to said winding (54) to incrementally rotate said first (52) motor, said assembly characterized by including a timer (62) that measures a the time to reach a predetermined resistance condition of said winding during each pulse and that terminates energy to said winding in response to said time being below a predetermined time period.

6. An assembly as set forth in claim 5 wherein said controller (56) includes a first pulse width modulator for receiving said pulses of energy for oscillating said energy in each pulse to said first winding of said first motor at a predetermined frequency.

* * * * *

UNITED STATES PATENT AND TRADEMARK OFFICE

CERTIFICATE OF CORRECTION

PATENT NO. : 7,191,680 B2
APPLICATION NO. : 10/225256
DATED : March 20, 2007
INVENTOR(S) : Rixon et al.

It is certified that error appears in the above-identified patent and that said Letters Patent is hereby corrected as shown below:

In Column 5, line 60, Claim 1, delete "interconnection" and please replace with -- interconnecting--.

In Column 6, line 7, Claim 1, after "pedal lever (34)" please insert -- for adjusting the operational position of said second pedal lever (34) --.

In Column 6, line 14, Claim 1, delete "the".

In Column 6, line 51, Claim 5, delete "the".

Signed and Sealed this

Twelfth Day of June, 2007

JON W. DUDAS
*Director of the United States Patent and Trademark Office*